US007890022B2

(12) United States Patent
Kweon et al.

(10) Patent No.: US 7,890,022 B2
(45) Date of Patent: Feb. 15, 2011

(54) COVER MEMBER, DEVELOPING CARTRIDGE AND DEVELOPING UNIT FOR IMAGE FORMING APPARATUS

(75) Inventors: Dae-Seob Kweon, Suwon-Si (KR); Joo-Hwan Noh, Yongin-Si (KR); Jong-Moon Eun, Yongin-Si (KR); Jean-Man Sur, Suwon-Si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 120 days.

(21) Appl. No.: 12/240,701

(22) Filed: Sep. 29, 2008

(65) Prior Publication Data

US 2009/0214257 A1 Aug. 27, 2009

(30) Foreign Application Priority Data

Feb. 22, 2008 (KR) ..... 10-2008-0016467

(51) Int. Cl.
*G03G 15/08* (2006.01)
*G03G 21/12* (2006.01)

(52) U.S. Cl. ..... 399/120; 399/258; 399/360

(58) Field of Classification Search ..... 399/120, 399/114, 113, 360, 258
See application file for complete search history.

(56) References Cited

U.S. PATENT DOCUMENTS 4,967,234 A 10/1990 Tani et al.
4,974,020 A 11/1990 Takamatsu et al.
4,977,429 A * 12/1990 Tani et al. ..... 399/27
5,381,217 A * 1/1995 Ishida ..... 399/120
5,479,247 A 12/1995 Watanabe et al.
5,493,366 A 2/1996 Satoh et al.
5,499,077 A 3/1996 Endo et al.
5,517,285 A * 5/1996 Nomura et al. ..... 399/120
5,589,915 A 12/1996 Hashimoto
5,960,238 A 9/1999 Ohgami
6,041,212 A 3/2000 Okada
6,104,888 A 8/2000 Kobayashi
6,151,459 A 11/2000 Hashimoto et al.
6,525,243 B1 2/2003 Stockman Campbell et al.

(Continued)

FOREIGN PATENT DOCUMENTS

EP 0 570 993 A1 11/1993

(Continued)

OTHER PUBLICATIONS

European Search Report issued in EP 09 15 0144, issued Jan. 22, 2010.

(Continued)

*Primary Examiner*—Constantine Hannaher
(74) *Attorney, Agent, or Firm*—Stanzione & Kim, LLP

(57) ABSTRACT

A developing unit includes a developer cartridge containing developer and a developing cartridge with a developing cartridge body comprising a mounting portion and a cover member. The mounting portion accepts the developer cartridge for replenishing developer consumed by the developing cartridge. The cover member closes an opening of the mounting portion when the developer cartridge is not inserted into the mounting portion. When a developing unit is initially constructed, printing is performed using developer contained in the developing unit. A developer cartridge containing developer can be inserted into the developing unit, allowing the supply of developer in the developing unit to be replenished.

22 Claims, 6 Drawing Sheets

U.S. PATENT DOCUMENTS

| | | | | |
|---|---|---|---|---|
| 6,526,243 | B2 | 2/2003 | Kim et al. | |
| 6,792,230 | B2 | 9/2004 | Saito et al. | |
| 6,980,758 | B2 | 12/2005 | Murayama et al. | |
| 7,197,263 | B2 * | 3/2007 | Kadowaki et al. | 399/120 |
| 7,340,197 | B2 | 3/2008 | Murayama et al. | |
| 2002/0085857 | A1 * | 7/2002 | Kim et al. | 399/119 |
| 2002/0085887 | A1 | 7/2002 | Schneider et al. | |
| 2003/0161653 | A1 | 8/2003 | Ban et al. | |
| 2004/0001723 | A1 | 1/2004 | Ashida et al. | |
| 2004/0223772 | A1 | 11/2004 | Nakazato | |
| 2005/0047821 | A1 | 3/2005 | Murayama et al. | |
| 2005/0095020 | A1 | 5/2005 | Eom et al. | |
| 2005/0175382 | A1 * | 8/2005 | Kweon | 399/360 |
| 2005/0260011 | A1 | 11/2005 | Murayama et al. | |
| 2006/0210285 | A1 | 9/2006 | Nakazato | |
| 2006/0285880 | A1 | 12/2006 | Okabe | |
| 2007/0230999 | A1 | 10/2007 | Shimomura | |
| 2008/0056772 | A1 | 3/2008 | Utsumi et al. | |

FOREIGN PATENT DOCUMENTS

| | | |
|---|---|---|
| EP | 0 672 971 | 9/1995 |
| EP | 1 437 632 | 7/2004 |
| EP | 1 840 671 | 10/2007 |
| EP | 1 881 378 | 1/2008 |
| JP | 60-238873 | 11/1985 |
| JP | 01-091164 | 4/1989 |
| JP | 09-022177 | 1/1997 |
| JP | 10-142910 | 5/1998 |
| JP | 11-24513 | 1/1999 |
| JP | 2000-75627 | 3/2000 |
| JP | 2000-075659 | 3/2000 |
| JP | 2004-264539 | 9/2004 |
| JP | 2005-326637 | 11/2005 |
| JP | 2005-338329 | 12/2005 |
| JP | 2007-025511 | 2/2007 |
| KR | 91-1489 | 1/1991 |
| KR | 10-2001-0061976 | 7/2001 |
| KR | 10-2005-0033796 | 4/2005 |
| KR | 10-2006-0034168 | 4/2006 |
| KR | 10-2006-0128338 | 12/2006 |
| RU | 2266553 | 4/2005 |

OTHER PUBLICATIONS

English language abstract of JP 2004-264539, published Sep. 24, 2004.
Machine English language translation of JP 2004-264539, published Sep. 24, 2004.
Office Action issued in Russian patent application No. 2008148667, mailed Dec. 11, 2009.
English language translation of Office Action issued in Russian patent application No. 2008148667, mailed Dec. 11, 2009.
Office Action issued in Russian patent application No. 2008148636, mailed Oct. 28, 2009.
English language translation of Office Action issued in Russian patent application No. 2008148636, mailed Oct. 28, 2009.
English language abstract of JP 2000-075659, published Mar. 14, 2000.
Machine English language translation of JP 2000-075659, published Mar. 14, 2000.
English language abstract of RU 2289835, published Dec. 20, 2006.
English language abstract of JP 2005-338329, published Dec. 8, 2005.
Machine English language translation of JP 2005-338329, published Dec. 8, 2005.
Machine English language translation of JP 10-142910, published May 29, 1998.
Machine English language translation of JP 11-24513, published Jan. 29, 1999.
Machine English language translation of JP 2000-75627, published Mar. 14, 2000.
Notice of Allowance issued in Russian Application No. 2008148634, mailed Jan. 21, 2010.
Partial English language translation of Notice of Allowance issued in Russian Application No. 2008148634, mailed Jan. 21, 2010.
English language abstract of RU 2,266,553, published Apr. 20, 2005.
English language abstract of JP 2007-025511, published Feb. 1, 2007.
Machine English language translation of JP 2007-025511, published Feb. 1, 2007.
European Search Report Issued in European Application No. 09 15 0066, mailed Jul. 29, 2009.
European Search Report Issued in European Application No. 09 15 2590, mailed Aug. 17, 2009.
English abstract of KR 10-2006-0128338, published Dec. 14, 2006.
English Language abstract of KR 91-1489, published Jan. 31, 1991.
English language abstract of KR 10-2006-0034168, published Apr. 21, 2006.
English language abstract of JP 09-022177, published Jan. 21, 1997.
Machine English language translation of JP 09-022177, published Jan. 21, 1997.
English language abstract of KR 10-2005-0033796, published Apr. 13, 2005.
English language abstract of KR 10-2001-0061976, published Jul. 7, 2001.
European Search Report issued in European Application No. 09 15 0141, mailed Apr. 14, 2009.
European Search Report issued in EP 09150067.8, mailed Jun. 3, 2009.
English language abstract of JP 60-238873, published Nov. 27, 1985.
English language abstract of JP 01-091164, published Apr. 10, 1989.
English language abstract of JP 2005-326637, mailed Nov. 24, 2005.
Machine English language translation of JP 2005-326637, mailed Nov. 24, 2005.
Chinese Office Action issued Jul. 26, 2010 in CN Application No. 200810174936.0.

* cited by examiner

COVER MEMBER, DEVELOPING CARTRIDGE AND DEVELOPING UNIT FOR IMAGE FORMING APPARATUS

CROSS-REFERENCE TO RELATED APPLICATIONS

This application claims priority from Korean Patent Application No. 10-2008-0016467, filed on Feb. 22, 2008, in the Korean Intellectual Property Office, the disclosure of which is incorporated herein by reference in its entirety.

BACKGROUND OF THE INVENTION

1. Field of the Invention

The present invention relates to an image forming apparatus, and more particularly, to a configuration of developing unit of an image forming apparatus.

2. Description of the Related Art

Developing units employed in compact image forming apparatuses such as laser printers may include an internal space for housing developer, a photosensitive medium, a developer supply unit for supplying developer and a waste developer collecting portion for collecting remaining developer, all of which are integrated as a single cartridge.

Due to such integration, despite the fact that the other components of the developing unit, e.g., photosensitive media and developer supply units, may have considerable remaining useful life, when developer is completely exhausted, a user needs to replace the entire developing unit with a new one at least in part due to the difficulties in only replenishing the developer by the user.

To avoid the cost of new developing unit, users may attempt to refill a used developing unit with additional supply of developer or to purchase from so called recycling vendors a used developing unit that has been refilled with developer. However, these refilling attempts are generally inadequate, as they are messy and may result in damage or reduced performance of the developing units if developer of inferior quality is used as replenishment.

Researches are on-going among the manufacturers of image forming apparatus to provide ways in which to allow replenishment of genuine quality developer by the users.

BRIEF DESCRIPTION OF THE DRAWINGS

Various features and advantages of the disclosure will become more apparent by the following detailed description of several embodiments thereof with reference to the attached drawings, of which.

DETAILED DESCRIPTION OF EMBODIMENTS

Figure 1:
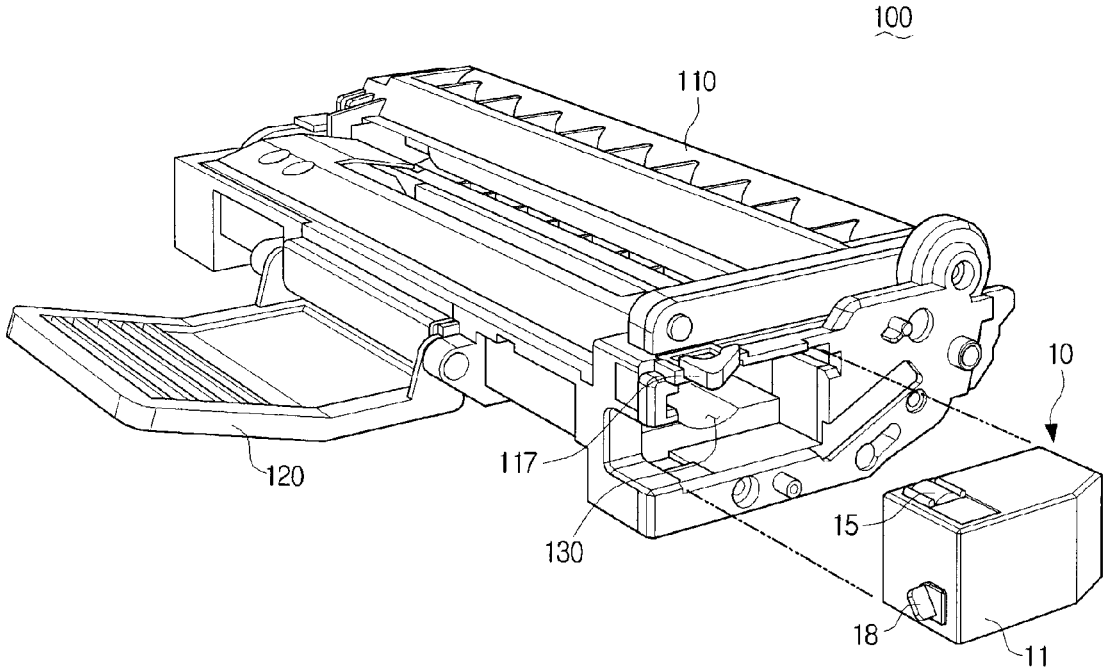
FIG. 1 is a perspective view of a developing unit of an image forming apparatus according to an embodiment of the invention.

In the following description, the same drawing reference numerals are used for the same elements in all drawings. The matters defined in the description, such as detailed construction and elements, are provided to assist in a comprehensive understanding of the invention. Thus, it should be apparent that the exemplary embodiments of the invention can be carried out without those specifically detailed matters. Also, well-known functions or constructions are not described in detail so as to avoid obscuring the description with unnecessary detail.

Referring to FIG. 1, a developing cartridge 100 according to an embodiment of the invention may include a cartridge body 110, a handle 120 and a mounting portion 130. The mounting portion 130 may be closed by a cover member 10. Reference numeral 117 denotes a waste developer outlet shutter unit, which is described in detail below.

The handle 120 may be pivotably mounted on the cartridge body 110. The handle 120 allows a user to attach or detach the cartridge body 110 to or from an image forming apparatus.

The mounting portion 130 has an opening on one side of the cartridge body 110, so that a developer cartridge 200 (see FIG. 7) which houses developer may be mounted in the mounting portion 130.

Figure 4:
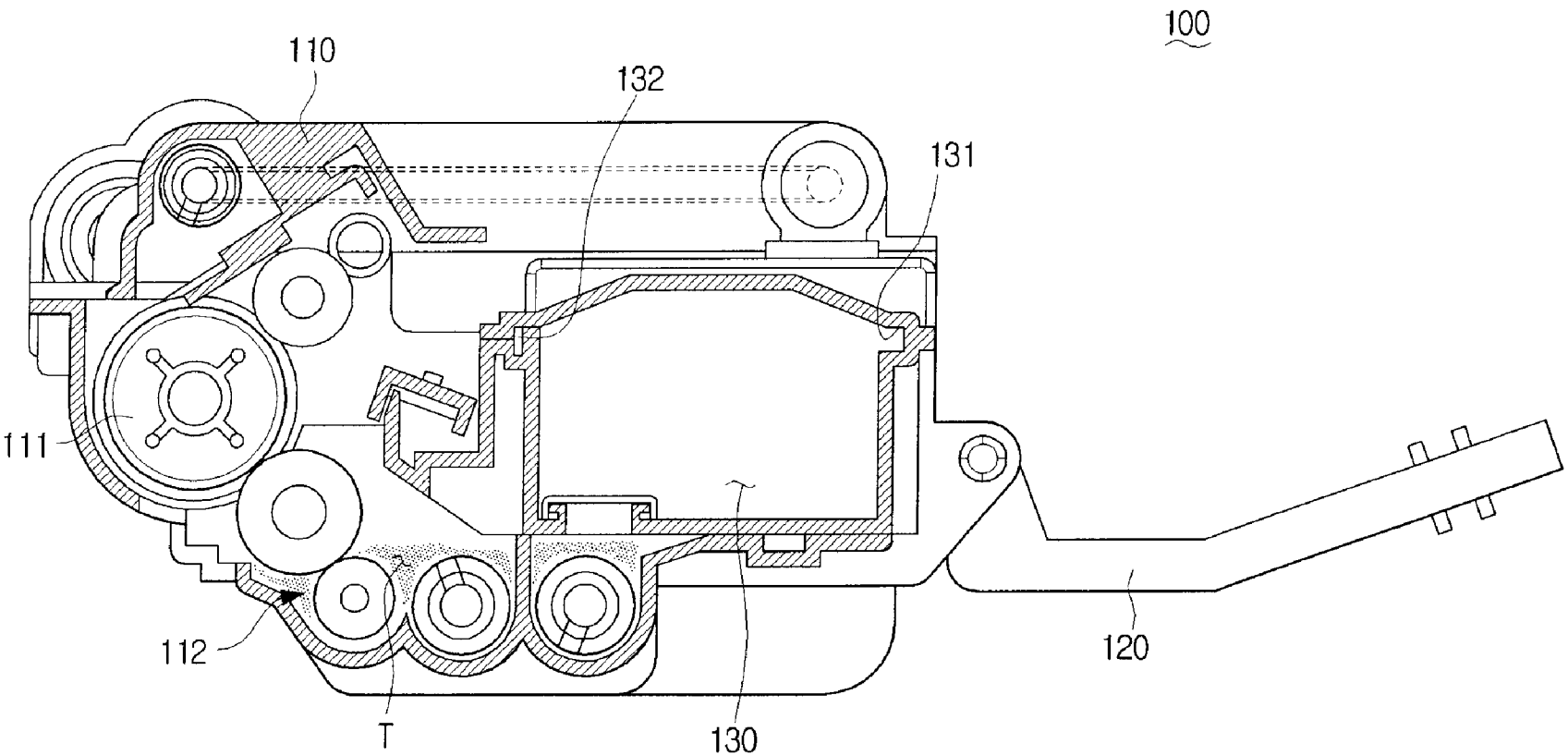
FIG. 4 is a cross-sectional view of a developing cartridge from which a cover member is removed, according to an embodiment of the invention.

Referring to FIG. 4, the cartridge body 110 includes a photosensitive medium 111 and a developer supply unit 112 which contains developer T used for printing. The developer cartridge 200 may supply additional developer when the developer contained in the developer supply unit 112 is exhausted or when additional supply of developer is required.

Figure 7:
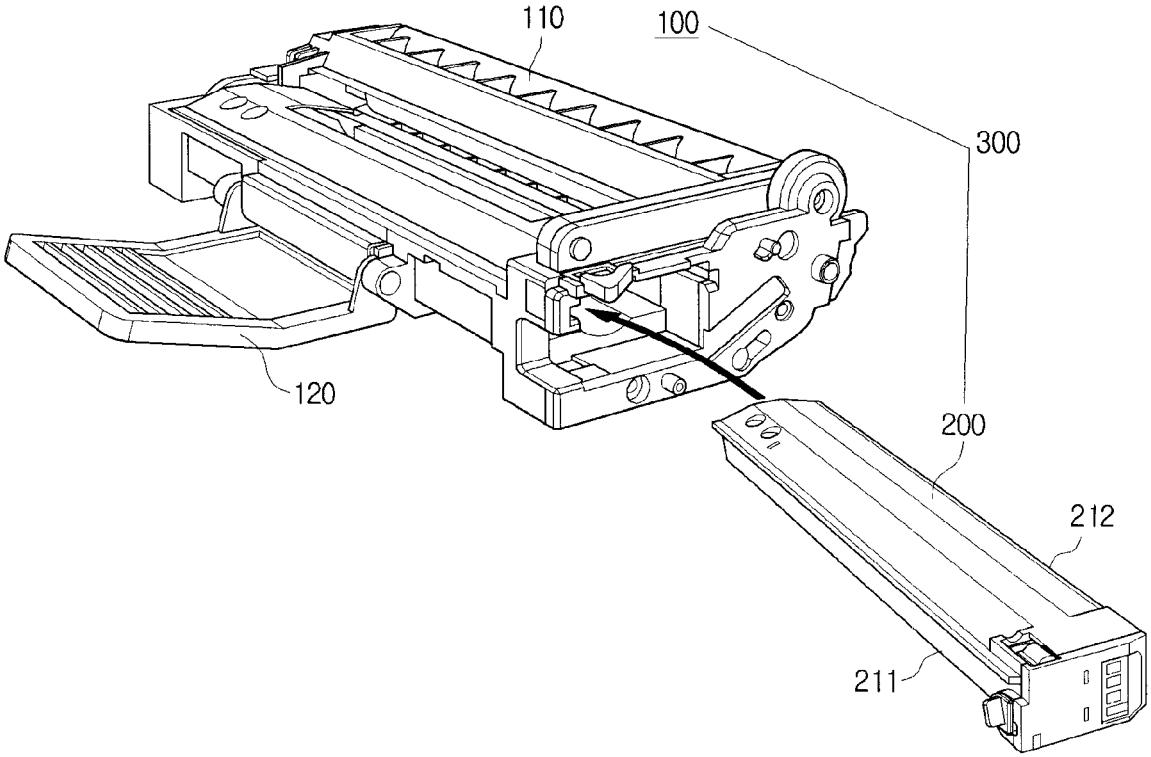
FIG. 7 is a perspective view of a developing unit from which a cover member is removed and to which a developer cartridge is attached, according to an embodiment of the invention.

The mounting portion 130 may include mounting guides 131 and 132. The mounting guides 131 and 132 may be formed on sides of the mounting portion 130 and may have concave and convex surfaces to guide the developer cartridge 200 into the mounting portion 130. As shown in FIG. 7, in one embodiment of the invention, the developer cartridge 200 may include guide traveling units 211 and 212 which correspond to the mounting guides 131 and 132 of the mounting portion 130, respectively, so that the developer cartridge 200 may be smoothly mounted in the mounting portion 130.

Figure 2:
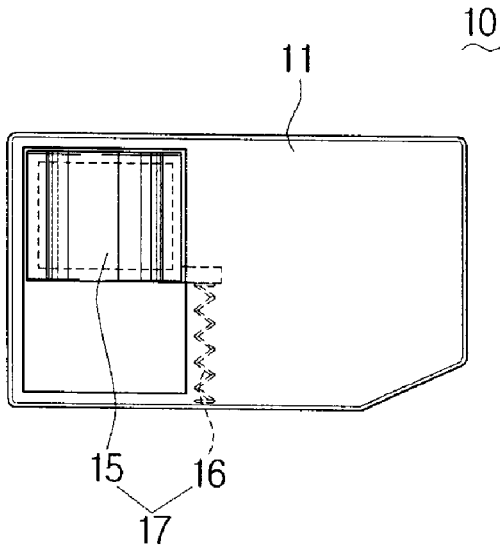
FIGS. 2 and 3 are plane views of a cover member according to an embodiment of the invention.
Figure 3:
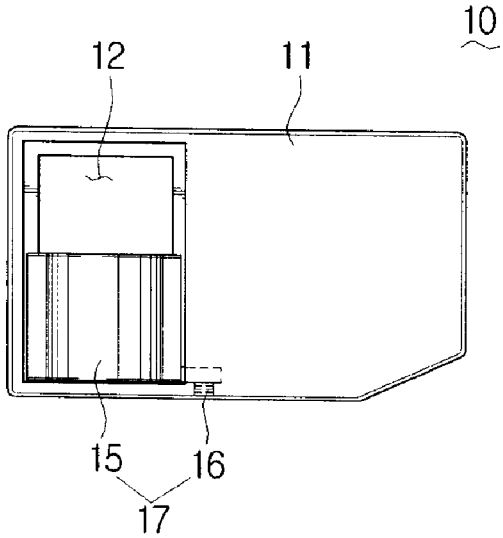
Figure 6:
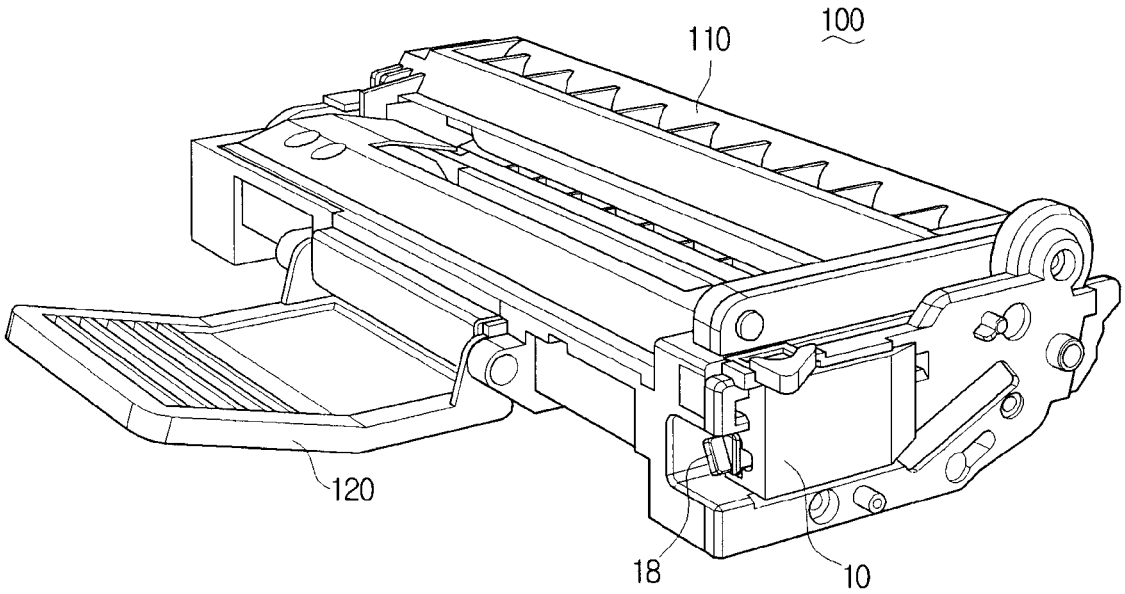
FIG. 6 is a perspective view of a developing cartridge in which a cover member is mounted, according to an embodiment of the invention.

Referring to FIGS. 1 and 6, the cover member 10 may be slidingly inserted or otherwise detachably inserted into the mounting portion 130 to seal the opening of the mounting portion 130. Referring to FIGS. 2 and 3, the cover member 10 includes a cover member body 11, a shutter unit 17 and a locking unit 18 (see FIG. 1).

Figure 5:
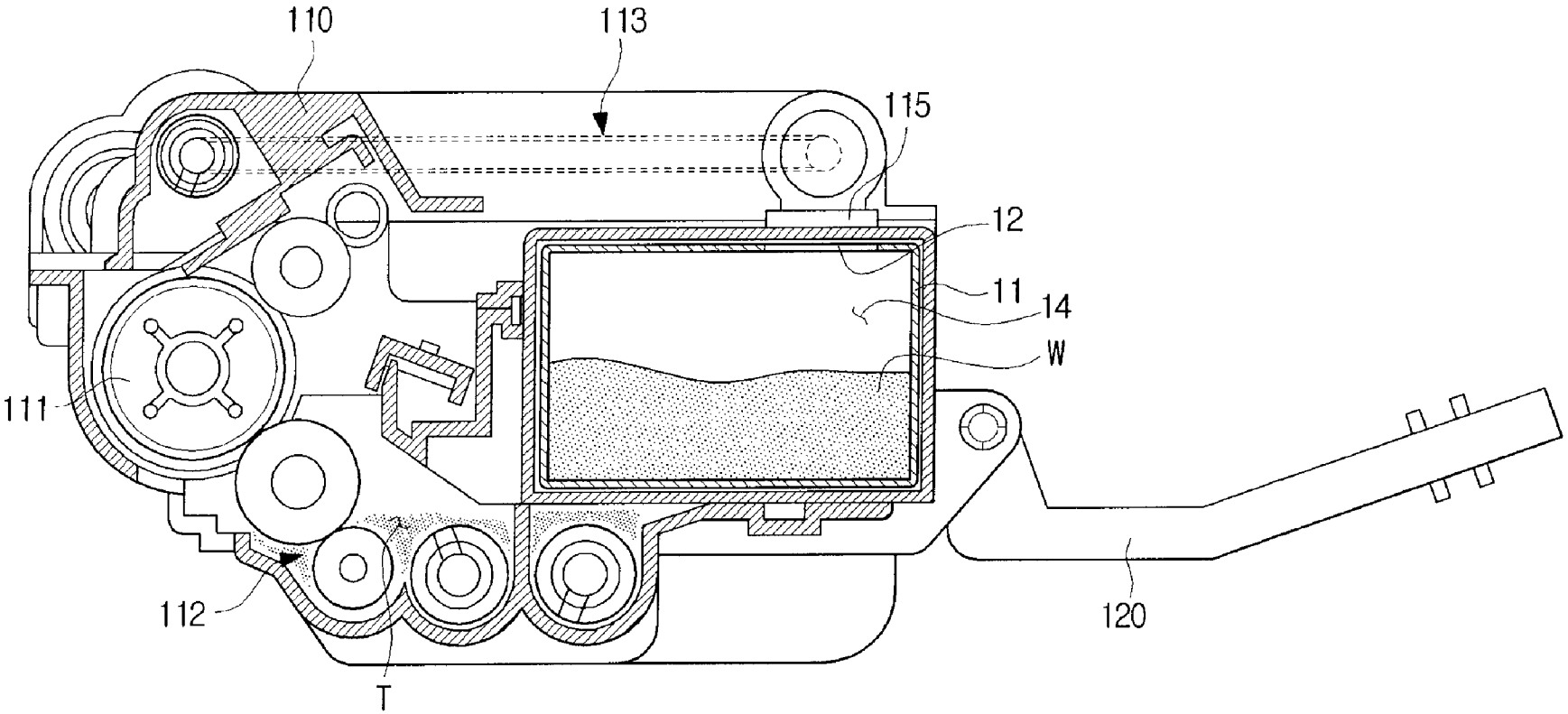
FIG. 5 is a cross-sectional view of a developing cartridge in which a cover member is mounted, according to an embodiment of the invention.

Referring to FIG. 5, the cover member body 11 is configured in the form of a box enclosing a space to house a waste developer collecting portion 14, and has a shape corresponding to the opening of the mounting portion 130 (see FIG. 1). Additionally, the cover member body 11 includes a waste developer inlet 12 which is formed on a surface thereof and through which waste developer generated as a result of printing using the developing cartridge 100 enters. A waste developer outlet 115 is formed on a surface of the cartridge body 110 opposite the waste developer inlet 12 of the cover member body 11.

Referring to FIGS. 2 and 3, the shutter unit 17 includes a sliding shutter 15 and an elastic member 16. When the cover member 10 is mounted in the developing cartridge 100, the sliding shutter 15 slides to an open position while one end of the sliding shutter 15 is blocked by the cartridge body 110, as shown in FIG. 3. The elastic member 16 elastically supports the sliding shutter 15 so that the sliding shutter 15 slides to a closed position in which the waste developer inlet 12 is sealed. According to the supporting operation of the elastic member 16, the sliding shutter 15 causes the waste developer inlet 12 to open when the cover member 10 is attached to the cartridge body 110 as shown in FIGS. 3 and 6. If the cover member 10 is separated from the cartridge body 110, as shown in FIG. 1, the sliding shutter 15 closes the waste developer inlet 12 as shown in FIGS. 1 and 2.

Referring to FIG. 7, a developing unit 300 according to an embodiment may include the developing cartridge 100 and the developer cartridge 200 is inserted into the mounting portion 130, which is exposed when the cover member 10 closing the opening of the developing cartridge 100 (see FIG. 6) is removed from the cartridge body 110. The developer cartridge 200 supplies developer to the developer supply unit 112 (see FIG. 4).

Hereinafter, an operation of the developing unit 300 of the image forming apparatus according to an embodiment of the invention will be described.

As shown in FIG. 4, the photosensitive medium 111 and developer supply unit 112 are disposed inside the cartridge body 110 of the developing cartridge 100, and the developer supply unit 112 contains developer T. A user may use the developing cartridge 100 until the developer T is substantially exhausted, although it should be understood that the developing cartridge 100 may be replenished using the developer cartridge 200 even before the developer T is completely exhausted.

The mounting portion 130 is disposed inside the cartridge body 110 to receive the developer cartridge 200 (see FIG. 7), from which replenishment of the developer that had been consumed by the developer supply unit 112 may be made. The mounting portion 130 may be sealed by the cover member 10, in order, e.g., to prevent external dust or dirt from being drawn therein, for example, when the developing cartridge 100 is initially manufactured, as shown in FIGS. 1 and 6, or during when the developing cartridge 100 is operated without a developer cartridge 200 installed by using the developer available in the developer supply unit 112.

Referring to FIG. 5, the cover member 10 acts to close the mounting portion 130 (see FIG. 6). Additionally, in one embodiment of the invention, the cover member 10 may include the waste developer collecting portion 14 disposed therein to collect waste developer W generated during printing operations. The waste developer W is conveyed to the waste developer outlet port 115 through a waste developer conveying unit 113, and is then collected in the waste developer collecting portion 14 via the waste developer inlet 12. The waste developer outlet port 115 may be opened by the outlet port shutter unit 117 (see FIG. 1) when the developing cartridge 100 is installed in an image forming apparatus (not shown), so as to fluidly communicate with the waste developer inlet 12.

When the developer in the developer supply unit 112 is substantially exhausted, a user removes the developing cartridge 100 from the image forming apparatus (not shown) by gripping the handle 120. Subsequently, the user operates the locking unit 18 of the cover member 10 to release the locking state, so that the cover member 10 is removed from the cartridge body 110.

As shown in FIG. 7, since the mounting portion 130 is accessible once the cover member 10 is removed, the user may insert the developer cartridge 200 into the mounting portion 130. When the developer cartridge 200 is mounted in the cartridge body 110, a developer contained in the developer cartridge 200 can be supplied to the developer supply unit 112 via a developer discharge port (not shown) provided between the developer cartridge 200 and the developer supply unit 112.

The foregoing embodiments and advantages are merely examples and are not to be construed as limiting the present invention. The present teaching can be readily applied to various other embodiments. Also, the description of the embodiments of the present invention is intended to be illustrative, and not to limit the scope of the claims, and many alternatives, modifications, and variations will be apparent to those skilled in the art.

What is claimed is:

1. A developing cartridge, comprising:

a developing cartridge body having a mounting portion into which to receive a developer cartridge to replenish the developing cartridge body with developer; and a cover member which closes an opening of the mounting portion when the developer cartridge is not installed in the developing cartridge body, wherein the cover member comprises a waste developer collecting portion.

2. The developing cartridge as claimed in claim 1, wherein the cover member further comprises:

a waste developer inlet through which waste developer enters the waste developer collecting portion; and a shutter unit which selectively opens and closes the waste developer inlet.

3. The developing cartridge as claimed in claim 2, wherein the shutter unit comprises:

a sliding shutter configured to slide to an open position when one end of the sliding shutter is blocked by the developing cartridge body when the cover member is mounted in the developing cartridge body; and an elastic member elastically supporting the sliding shutter so that the sliding shutter slides to a closed position.

4. The developing cartridge as claimed in claim 3, wherein the waste developer inlet and the shutter unit are disposed on a top surface of the cover member.

5. The developing cartridge as claimed in claim 1, wherein the cover member is slidingly received into the opening of the mounting portion.

6. The developing cartridge as claimed in claim 1, wherein the cover member is removed when the developer cartridge is inserted into the developing cartridge.

7. The developing cartridge as claimed in claim 1, wherein the mounting portion comprises a mounting guide having a concave and convex surface, and the developer cartridge comprises a guide traveling unit corresponding to the mounting guide of the mounting portion.

8. A developing unit, comprising:

a developing cartridge including a developer supply unit, which contains developer, and a mounting portion having an opening facing a wall surface on one side of the developing cartridge;

a developer cartridge, which is configured to be inserted into the mounting portion to supply developer to the developer supply unit; and a cover member which closes the opening of the mounting portion when the developer cartridge is not inserted into the developing cartridge, wherein the cover member is removed when the developer cartridge is inserted into the developing cartridge, and the cover member comprises a waste developer collecting portion.

9. The developing unit as claimed in claim 8, wherein the cover member comprises a shutter unit which is open when the cover member closes the opening of the mounting portion.

10. The developing unit as claimed in claim 9, wherein the shutter unit comprises:

a sliding shutter which slides to an open position while one end of the sliding shutter is blocked by the developing cartridge when the cover member is mounted in the developing cartridge; and an elastic member elastically supporting the sliding shutter so that the sliding shutter slides to a closed position.

11. A cover member detachably mounted in a developing cartridge body, the developing cartridge body comprising a mounting portion into which is received a developer cartridge to replenish the developing cartridge body with developer, the cover member closing an opening of the mounting portion when the developer cartridge is not inserted into the developing cartridge, wherein the cover member comprises a waste developer collecting portion.

12. The cover member as claimed in claim 11, comprising:

a waste developer inlet through which waste developer enters the waste developer collecting portion; and a shutter unit which selectively opens and closes the waste developer inlet.

13. A developing cartridge usable in an image forming apparatus, comprising:

a developing cartridge body including a mounting portion into which a developer cartridge containing a supplemental quantity of developer is to be received, the developing cartridge body including therein a supply of developer for use by the developing cartridge to allow the developing cartridge to operate without the developer cartridge being installed in the mounting portion; and a cover member receivable into, and to thereby close, an opening of the mounting portion when the developer cartridge is not installed in the mounting portion, wherein the cover member comprises a waste developer collecting portion in which to store waste developer.

14. The developing cartridge according to claim 13, wherein the cover member further comprises:

a waste developer inlet through which to receive the waste developer into the waste developer collecting portion; and a shutter unit configured to selectively open and close the waste developer inlet.

15. The developing cartridge according to claim 14, wherein the shutter unit comprises:

a sliding shutter configured to interfere with a portion of the developing cartridge body such that the sliding shutter slides into an open position when the cover member is received into the mounting portion; and an elastic member configured to elastically bias the sliding shutter so that the sliding shutter slides to a closed position.

16. The developing cartridge according to claim 15, further comprising:

a waste developer outlet formed on the developing cartridge body to be aligned with the waste developer inlet of the cover member; and a second shutter unit configured to selectively open and close the waste developer outlet.

17. The developing cartridge according to claim 13, wherein the cover member comprises:

a locking member disposed to be accessible when the cover member is installed in the opening, the locking member being configured to selectively lock the cover member in place in the opening and to release the cover member so that the cover member is able to be removed from the opening.

18. The developing cartridge according to claim 13, wherein the mounting portion includes a mounting guide having a first surface shape, and the developer cartridge comprises a guide traveling unit having a second surface shape corresponding to the first surface shape of the mounting guide of the mounting portion.

19. A cover member usable with a developing cartridge of an image forming apparatus, comprising:

a cover member body receivable into an opening of a mounting portion provided in the developing cartridge, the mounting portion being configured to receive a developer cartridge containing a supplemental amount of developer, the cover member being capable of being received into the mounting portion when the developer cartridge is not mounted therein; and a waste developer collecting portion provided in the cover member body into which waste developer received from the developing cartridge is to be stored.

20. The cover member according to claim 19, further comprising:

a waste developer inlet through which to receive the waste developer into the waste developer collecting portion; and a shutter unit configured to selectively open and close the waste developer inlet.

21. The cover member according to claim 20, wherein the shutter unit comprises:

a sliding shutter configured to interfere with a portion of the developing cartridge such that the sliding shutter slides into an open position when the cover member body is received in the opening of the mounting portion; and an elastic member configured to elastically bias the sliding shutter so that the sliding shutter slides to a closed position when the cover member body is removed from the developing cartridge.

22. The cover member according to claim 19, further comprising:

a locking member disposed to be accessible when the cover member body is received in the opening of the mounting portion, the locking member being configured to selectively lock the cover member body in place in the opening, and to release the cover member so that the cover member body is able to be removed from the developing cartridge.

* * * * *